United States Patent [19]

Kuehn, Sr.

[11] Patent Number: 4,513,875

[45] Date of Patent: Apr. 30, 1985

[54] FLOWABLE SUBSTANCE CONTAINER AND DISPENSER

[76] Inventor: Jack W. Kuehn, Sr., 3500 W. Highway 13, Burnsville, Minn. 55337

[21] Appl. No.: 570,235

[22] Filed: Jan. 12, 1984

Related U.S. Application Data

[63] Continuation-in-part of Ser. No. 485,661, Apr. 18, 1983, abandoned.

[51] Int. Cl.[3] ..... B65D 7/02

[52] U.S. Cl. ..... 220/214; 220/5 R; 220/253

[58] Field of Search ..... 220/214, 253, 258, 70, 220/, 72, 74, 5 R

[56] References Cited

U.S. PATENT DOCUMENTS

| | | | |
|---|---|---|---|
| 2,328,246 | 8/1943 | Albion | 220/253 |
| 3,840,141 | 10/1974 | Allom et al. | 220/5 R |
| 4,372,454 | 2/1983 | Carlson | 220/5 R X |

*Primary Examiner*—Steven M. Pollard

*Attorney, Agent, or Firm*—Merchant, Gould, Smith, Edell, Welter & Schmidt

[57] ABSTRACT

Device for storing and dispensing a flowable substance that includes a container (20) having container apertures (50) and a multiply positionable lid (21) having lid apertures (49). With the lid (21) in the closed position, the lid (21) cannot be lifted from the container (20) and there is not access to the flowable substance. When the lid (21) is in the access position, the container and lid apertures align, allowing access to the flowable substance when an access seal (37) is altered. A third position, the remove position, allows removal of the lid (21) after the breaking of a lid removal indicator (51) so that tampering with the interior of the container (21) may be ascertained by, for example, the food supplier. Further embodiments include a rolling ring (30) having hanging holes (31) that preclude vertical hanging; a handle ring (28) having handle holes (29) that are angularly offset from the hanging holes (31); forklift and nesting capability; an identification card holding nipple (43); a bayonet engagement between the container (20) and the lid (21); a funnel shaped sump (26); and double-walled construction, e.g., for enhanced strength and thermal insulation. A gap (70) between the inner wall (20*a*) and outer wall (56, 57) of the double-walled device (58) is preferably filled, depending on the application of the device (58), with a neutralizing, capturing, heat insulating, indicating, or strengthening substance. A given gap-filling substance can possess any combination of the properties mentioned above, among others.

83 Claims, 11 Drawing Figures

FLOWABLE SUBSTANCE CONTAINER AND DISPENSER

TECHNICAL FIELD

This is a continuation-in-part of application Ser. No. 485,661 filed on Apr. 18, 1983, now abandoned.

The invention of the present application relates generally to the field of containers and dispensers. More particularly, this invention relates to a container for storing and dispensing flowable substances, liquids, or liquid-like substances including food products, and the container has a multiply positionable lid selectively allowing access to the substances. An indicator connected to the lid and the container signals the removal of the lid, the removal allowing replacement of the seal and access to the interior of the container.

BACKGROUND OF THE INVENTION

Devices for storing and dispensing liquid and liquid-like substances are well-known and serve a useful purpose. "Fast-food" retailers, for example, often purchase pre-mixed food products that also come pre-packaged in relatively large containers. Such containers are stored in a refrigerated area prior to and during dispensing of the food product.

It should be noted that liquid and liquid-like substances that are stored and dispensed by the present invention include beverages, slushes, ice cream, ice milk and dairy-grade mixes. In fact, the invention accommodates any substance that can be stored in a container and withdrawn or pumped through an aperture in the container, including granular or powdered substances that "flow" in a manner analogous to a liquid. The word "liquid" in this application therefore henceforth refers to any or all of the substances discussed above, among others. Although the remainder of this application primarily discusses liquid food products, it is understood that other flowable substances, liquids and liquid-like substances may be stored and dispensed using the invention. For example, petroleum products and adhesives can be accommodated. The device of the present invention can also accommodate substances which change from liquid to solid state after filling due to, for example, a change in temperature.

The prior art includes several different types of liquid food product containers, each type suffering from various disadvantages. Traditional metal milk cans and variations thereof are very common. All such cans are relatively heavy and expensive and require expensive retinning maintenance. Particular designs have other disadvantages.

One type of metal milk can, represented by U.S. Pat. No. 982,012 issued to C. E. North, includes a neck having a vertical aperture that can align with a similar aperture in a lid. The lid is constrained by a breakable seal that is attached to the can and to the lid. The apertures can be aligned without breaking the seal so that milk can be added to or withdrawn from the can through the apertures. The lid cannot be completely removed to allow more complete access to the interior of the can for cleaning purposes without breaking the seal. Thus, the can is intended and designed to be cleaned only by authorized personnel and not by the dairy farmers. However, unauthorized personnel can gain access to the interior of the can through the apertures without breaking the seal; milk can be readily withdrawn and foreign products added and the recipient of the can has no means of detection.

Another milk can design, represented by U.S. Pat. No. 274,745 issued to G. W. Evans, is directed to the unauthorized access problem. A breakable seal covers a locking mechanism that prevents movement of the lid. Once the seal is broken the mechanism can be unlocked. Therefore, a broken seal indicates that the lid may have been removed. One problem with this design is that the lid must be completely removed even before an authorized access. It is often preferrable to keep the lid engaged with the container during use so that the risk of spilling is minimized and foreign matter is prevented from falling into a gaping hole, typically horizontal, in the container.

Brief mention was made above of the need to clean the food containers. This usually involves removing the lid and the use of a liquid cleaning solution. After cleaning, the containers are hung in an inverted orientation so that they can drain. Hanging holes are often provided at the base of the container for this purpose.

One problem with hanging holes in the prior art is that they potentially allow the container to hang vertically. A vertical container generally does not drain as well as a non-vertical container. Horizontal surfaces on the lower edge of prior art hanging holes contribute to this problem. U.S. Pat. No. 3,143,242, for example, shows hanging holes of this type.

In addition to the problems outlined above, the prior art food containers do not include convenient means for identifying the container and its contents.

Finally, the prior art does not include a design that adequately addresses the above-discussed problems and, at the same time, includes means for stacking or nesting of containers; a handle ring and rolling ring that accommodate forklift tynes; bayonet mounting means for the lid; double-wall construction for insulation and other purposes; bumpers or rollers for level rolling of the device on its side.

Although, in general, the aforementioned food containers have performed satisfactorily, these devices have not been found to be entirely suitable. The present invention solves many of the problems discussed above. Specifically, the present invention provides a container and dispenser that includes means for determining whether unauthorized access of any kind has been effected while at the same time allowing ready access for an authorized user without requiring removal of the lid.

The present invention also provides a hanging hole that substantially precludes vertical hanging and eliminates the pooling of liquids on the hole's lower surface when the container is hanging upside down.

Addressing the other aforementioned problems, further embodiments of the instant invention include a plastic container that is nestable and rollable, that accommodates forklift manipulation by either a forktruck, hand truck or drum truck, that inclues a bayonet lid engagement scheme, and double-walled construction. In the double-walled embodiment, a void between the two walls can be filled with various substances to improve the efficiency, strength and safety characteristics of the container. Alternatively, the void can be evacuated to improve the container's heat insulation properties.

It should be emphasized that the invention is not limited to any particular size or capacity. That is, the container could, for example, serve as an alternative to traditional 55 gallon drums. The invention is not limited to 55 gallon capacity, however.

SUMMARY OF THE INVENTION

The present invention is a device for storing and dispensing a liquid substance that includes a container having an aperture and a multiply positionable lid having an aperture that can align with the container's aperture. Two seals are further provided: one seal preferably indicates when the inside of the container has been accessed through the aligned apertures, and another seal or indicator indicates when the lid has been placed in the remove position.

The container also may include a rolling ring having a unique hanging hole. The hole is designed to eliminate substantially flat lower surfaces parallel to the bottom edge of the rolling ring and allows draining of the rolling ring when the container is hung in an inverted orientation.

The present invention also provides for the container or its associated components or both to be made of plastic. Transparent or translucent plastic or molded rubber-like compounds or metal may be used.

Further embodiments allow for nesting of containers by making the container and lid combination fit into and support the bottom of a similar container.

A handle ring having a handle hole is further provided. One embodiment shows the handle hole offset from the hanging hole to minimize the impact stress if the container should be dropped during the cleaning or drying process or while it is being carried using the handle hole in the handle ring.

Additional embodiments include a nipple that accommodates an identification card, a bayonet lid engagement assembly and a double-wall construction for the container.

A void between the sidewall layers of a double-walled container preferably contains a neutralizing substance to mitigate deleterious effects caused by the liquid substance in the event of a leak; a heat insulating substance; an indicator substance which is detectable in the event of a leak through the container's sidewall; or a strengthening substance which increases the strength of the container's sidewall.

DETAILED DESCRIPTION OF THE INVENTION

Figure 1:
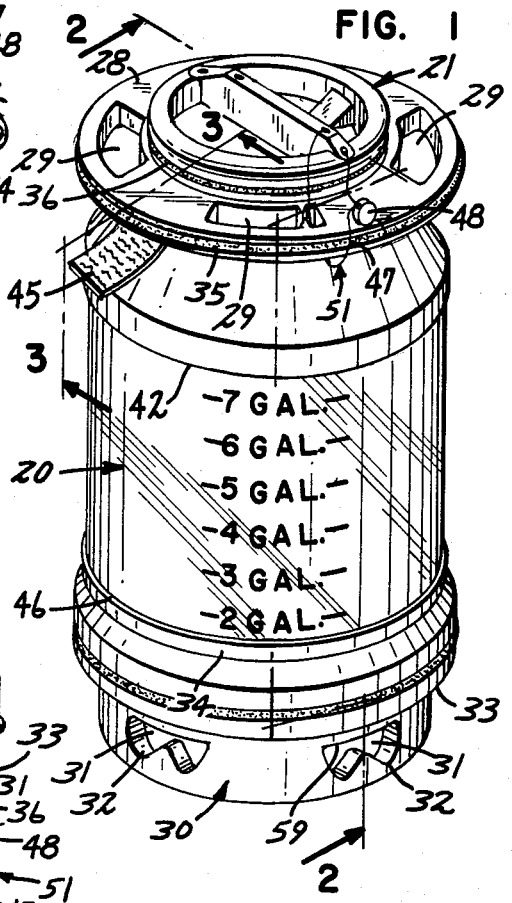
FIG. 1 is a perspective view of a food storage and dispensing device in accordance with one embodiment of the invention.

Referring now to the drawings wherein like reference numerals denote like elements throughout the several views, FIG. 1 illustrates, in perspective, a preferred embodiment of the invention in accordance with the present application. As shown in FIG. 1, a preferred embodiment includes a container 20 and a lid 21. The container 20 is preferrably made of a transparent or translucent plastic and is calibrated and marked in gallon increments so that the user may easily determine the amount of fluid food product remaining in the container at any time. A preferred use for such a container and lid assembly is by a food retailer for storing and dispensing a dairy-grade product, e.g., soft serve or the like. This preferred utilization for the invention and the manner of fabrication of the device will be more fully described below.

Figure 2:
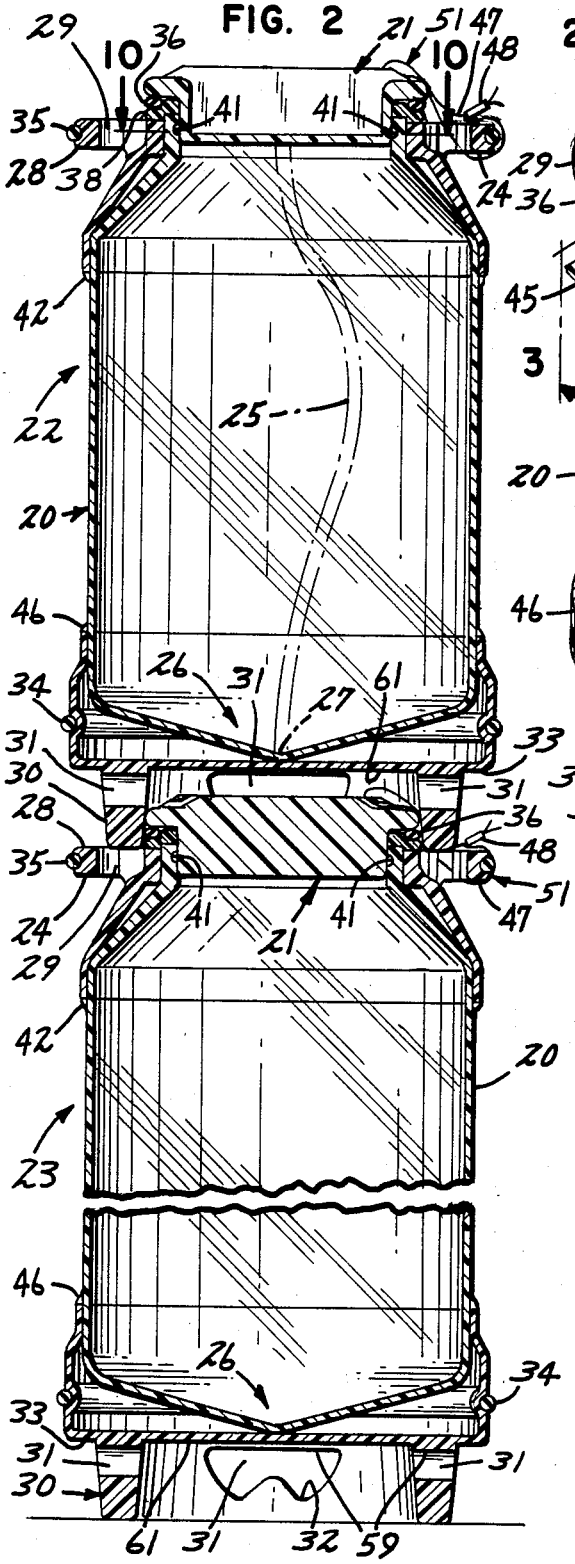
FIG. 2 shows two nested devices, each device being the embodiment illustrated in FIG. 1 in cross section taken generally along line 2—2. The lid of the top-most device is in the access position and a dispensing tube is inserted.

FIG. 2 shows a cross-sectional view of two of the aforementioned preferred devices nested together. "Nesting" is the stacking of devices with the top of one device cooperatively engaging and supporting the bottom of another device. As shown in FIG. 2, a bottom device 23, including a lid 21, fits into and supports a rolling ring 30 at the bottom of a device 22. The device 22 is in the dispensing mode, having its lid 21 in the "access" position and a dispensing tube 25 inserted into the container 20. The dispensing tube is preferrably used in conjunction with a pump (not shown) to withdraw the liquid food product from the container 20. The device 23 is not in use in FIG. 2, though once the device 22 is substantially empty it may be removed, permitting access to the device 23 so that its contents may likewise be dispensed. The nesting also provides for more effective utilization of space while storing either empty or full devices.

Still referring to FIG. 2, the container 20 is the component of the food storage and dispensing device of the present invention that actually contains the liquid food product (not shown). It is preferrably made of a transparent or translucent plastic so that the amount of food product contained can be easily ascertained. Polyethylene is preferable, though other plastics may also be used, as is appreciated by those skilled in the art of plastic molding, provided that the material is strong enough to contain and is qualitatively and quantitatively compatible with the liquid while at the same time accommodating forklift manipulation and occasional rough handling. The wall thickness of the container 20 is not critical, the only constraints being that the device be relatively light-weight and strong. The container 20 could also be comprised of multiple layers of a plastic material to improve its strength and thermal insulation properties as discussed more fully below. When a plastic is used to form the container 20, blow molding is the preferred manufacturing process, a technique that is well-known in the plastic molding art. The container could of course be fabricated using materials other than a plastic, e.g. metal, in which case blow molding would likely be inappropriate. Importantly, though the container 20 is illustrated as having a circular cross section, the invention contemplates other configurations, e.g., rectangular, hexagonal or oblong. A rectangular, including square, shape would permit a higher packing density than a round cross section.

The container 20 preferably has a funnel-shaped sump, generally indicated at 26 in FIG. 2. This configuration allows for more complete emptying of the container 20 when the liquid food product is being sucked out of the container by a pump (not shown) connected to the dispensing tube 25. When the dispensing tube 25 is inserted into the container 20, the funnel-shaped sump guides an end 27 of the dispensing tube 25 down to the apex of the funnel located at the bottom of the container 20, further contributing to complete emptying. Of course, the sump need not have a circular conical shape, particularly in the case where the container 20 has a rectangular cross section. In that case, the sump may have a shape that approximates an inverted pyramid.

The lid 21 engages the top end of container 20. The lid 21 is also preferably made of a plastic material such as polyethylene, but transparency or translucency of the lid 21 is not as important as it was in the case of the container 20. If the container 20 is fabricated using a metal, e.g., aluminum, it would be preferable to also make the lid 21 out of metal so that a seal between the lid 21 and the container 20 may be sustained during thermal expansion and contraction as is well-known in the art. The lid 21 also includes means for sealably and removably engaging the container 20. This means will be discussed in detail below.

Referring now to device 23 of FIG. 2, two more major components of the preferred embodiment of the invention are identified. A handle ring 28 extends from the container 20 proximate to the top end of the container 20. The handle ring 28, like the container 20 and the lid 21, is preferably made of molded plastic. It should be noted that the invention comprehends that the handle ring 28 could be an integral part of the container 20 rather than a separate part as shown in FIG. 2. The handle ring 28 preferably has a plurality of handle holes 29 equally spaced around the ring that are sufficiently large to accommodate an average adult human hand. Additionally, the handle ring 28 should be strong enough and attached to the container 20 in such a way as to support at least one other device that contains a full charge of liquid food product for nesting purposes. Furthermore, a lower surface of the handle ring 28, generally indicated at 24, is preferably substantially flat and horizontal and large enough to accommodate the tynes of a forklift. The design details involved in making the handle ring 28 strong enough to permit nesting and forklifting are well-known to those skilled in the art of plastic or metal fabrication. Again it should be noted that although the term "ring" is used, the handle ring 28 could have a non-circular shape, particularly in the case of a non-circular container 20. An upper roller/bumper 35 is carried by the handle ring 28. The upper bumper 35 is preferably a resilient material such as rubber. A large rubber O-ring would suffice, at least when the handle ring 28 is circular.

Still referring to the device 23 of FIG. 2, a rolling ring 30 extends from and is proximate to the bottom end of the container 20; i.e., beneath and partially surrounding the sump 26. Plastic is the preferred material for the rolling ring 30 if the container 20 is of plastic construction. As was noted with regard the handle ring 28, the rolling ring 30 may be an integral part of container 20 rather than a separate part as shown in FIG. 2. In contradistinction to the handle ring 28, the rolling ring 30 is preferably substantially rollable with any angles rounded even if the cross section of the container is, for example, rectangular or hexagonal. The rolling ring 30 should be approximately circular so that the entire device can be tipped and rolled on the ring 30, a particularly important feature when the storage device is fully charged and must be manually moved.

In a preferred embodiment, the rolling ring 30 includes several hanging holes equally spaced around the ring, one of which is generally indicated at 31. The hanging hole 31 is designed to accommodate a hanging hook or line (not shown) so that the device can be hung in an inverted orientation after cleaning for drying purposes. Although hanging holes are not generally new, the hole 31 has several unique features. A lower edge 32 of the hanging hole 31 is not substantially parallel to the bottom edge of the rolling ring 30 either in the radial or tangential direction, thus minimizing the pooling of cleaning solution when the container is upright. Preferably, the lower edge 32 is rounded in the radial direction, in a convex fashion, thus improving the draining of the solution. In the tangential direction the lower edge 32 is also preferably non-horizontal. The sinusoidal shape as shown in FIG. 2 is particularly useful for hanging purposes: when a hanging line or rod (not shown) is inserted through the hole 31 and through another hole on the opposite side of the rolling ring 30, the sinusoidal shape lessens the possibility that the line or rod will pass through the longitudinal axis of the container 20. This being the case, the inverted device will hang non-vertically, improving the draining and drying qualities of the device. Of course, if a simple hook (not shown) is used to engage a single hanging hole 31 in the rolling ring 30, the device 23 will also hang non-vertically. An upper edge 59 of hanging hole 31 is preferably substantially flush with the inside bottom surface 61 of rolling ring 30 so that cleaning solution may completely drain through the rolling ring 30 when the device 23 is hung in an inverted position to dry.

Furthermore, the hanging holes 31 are preferably positioned in the rolling ring so that they are angularly offset from the handle holes 29, as best seen in FIG. 1. The two types of holes are offset so that, in impact stress on the handle 28 is minimized. That is, assuming that a hook is used to support the device, engaging a single hanging hole 31, if the device is inadvertently dropped the device will likely land on the handle ring 28. If the impact occurs at a solid portion of the handle ring 28, the stress is minimized and fracture of the device is less likely.

Additionally, the rolling ring 30 preferably has a ledge indicated generally at 33 that is substantially parallel to the bottom edge of the rolling ring 30. The tynes of a forklift may engage the ledge 33 so that the device 23 and any nested devices may be moved, for example, from a refrigerated storage area to a shipping area. Clearly, the rolling ring 30 may be comprised of a plurality of components of varying outside dimensions to create the ledge 33.

A lower bumper 34 is carried by a groove in the rolling ring 30. The lower bumper 34 is preferably a resilient material such as natural, synthetic or silicone rubber. On the other hand, the lower bumper 34 could be formed from a relatively hard molded rubber product or the like. A large rubber O-ring would suffice, at least when the top edge of the rolling ring 30 is circular. The upper bumper 35 and lower bumper 34 are preferably circular to allow rolling of the device 23 when it is laid on its side. The bumper 34 and 35 lessen rolling resistance and abrasion, thereby making the device 23 more maneuverable, longer lasting, and easily rolled on its side in a level manner or attitude.

Figure 3:
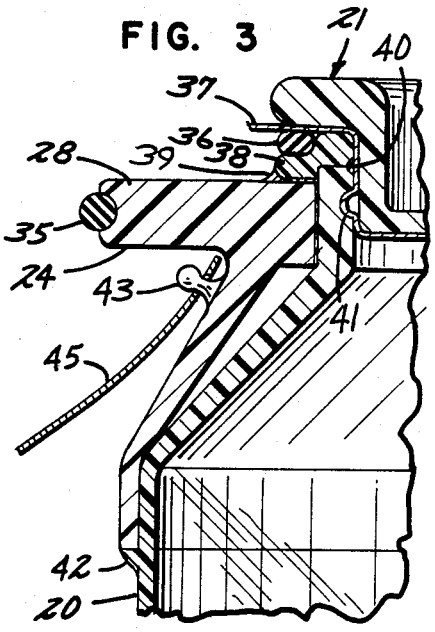
FIG. 3 is an enlarged cross-sectional view of a portion of the embodiment illustrated in FIG. 1 taken generally along the line 3—3.

FIG. 3 is an enlarged cross section of a portion of a preferred embodiment showing the handle ring 28 and the lid 21 engaged with the container 20. A binding ring 38 is cooperatively connected to a top surface of the handle ring 28 and to the container 20. The binding ring 38 is preferably made of a plastic material, and is preferably spin welded to the top surface of the plastic handle ring 28 at a first spin weld 39 and is spin welded to the container 20 at a second spin weld 40. As well-known in the art of plastic fabrication, the spin welds can be made without a solvent. Similarly, the handle ring 28 is spin welded to container 20 at a third spin weld 42, and the rolling ring 30 is spin welded to the container 20 at a fourth spin weld 46 as shown in FIG. 2. In lieu of or in conjunction with spin welding an adhesive, e.g. epoxy, could be used.

Still referring to FIG. 3, a breakable access seal 37 is interposed between the lid 21 and the container 20. The access seal 37 is preferably waxed paper or a high density polyethylene film when a dairy-grade product is being stored. It should be noted that a high density polyethylene film or the like is preferred for the storage of products containing oxidatively-sensitive oil or fat. The invention comprehends the use of any paper or plastic film, however. The breakable access seal 37 acts to seal the contents of container 20 until the food retailer breaks the seal 37 as discussed below. It should be noted that the seal 37 need not necessarily be broken when the food retailer wishes to dispense the food product; the seal 37 may simply be deformed to allow the insertion of the dispensing tube 25. It should also be noted that the device will function in the absence of the access seal 37 if a compressible seal 36 is present.

FIG. 3 also shows a bayonet groove indicated generally at 41. The groove 41 is formed in the container 20 and is shaped to accommodate a lug 44 that is an integral part of the lid 21 as more clearly shown in FIG. 10. The lug 44 could of course be a separately fabricated part that is fixedly connected to the lid 21 using, for example, an adhesive. The groove 41 will be more fully discussed with reference to FIGS. 8 and 10 below.

FIG. 3 shows a nipple 43 that is attached to the handle ring 28 and is shaped to accommodate an identification card 45. The nipple 43 could alternatively be an integral extension of the handle ring 28. The nipple 43 has an enlarged end that may be forced through a hole in the identification card 45. The identification card 45 might identify the supplier, retailer or contents and related information regarding the container 20.

Figure 4:
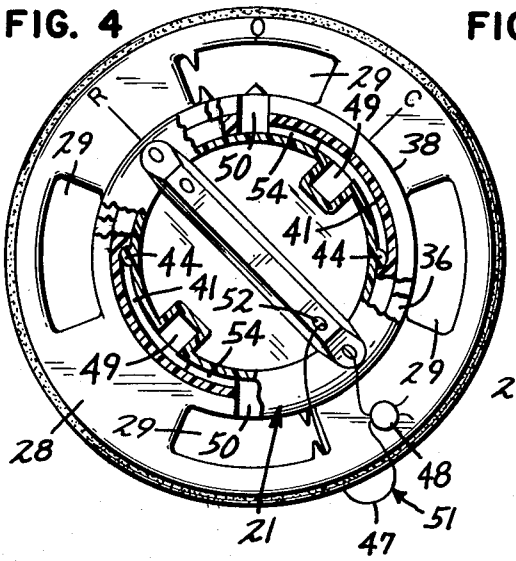
FIG. 4 is a top plan view, partly in section, of the embodiment illustrated in FIG. 1, wherein the lid is in the closed position an a lid removal indicator, a loop of wire, is intact.

FIG. 4 is a plan view, partly in section, of the preferred embodiment, and it shows the bayonet engagement assembly in greater detail. The bayonet groove 41 in the container 20 cooperatively engages the lug 44 extending from the lid 21. The lid 21 also has a pair of lid apertures, 180° apart, generally indicated at 49, and the container 20 has a pair of container apertures, 180° apart, indicated generally at 50. The lid apertures 49 are relatively small portions of the otherwise vertical wall of the lid 21 that slope downward and inward toward the center of the container; the container aperture 50 are notches in the upper rim of the container 20. When the lid apertures 49 are aligned with the container apertures 50 there is access to the liquid food product within the container 20. It should be noted that the two pairs of apertures, 49 and 50 respectively, form two means of access when they are aligned. Thus, one pair of aligned apertures will admit dispensing tube 25 while the other pair of apertures forms a venting port to facilitate pumping or pouring of the liquid food product or other flowable substance.

Figure 6:
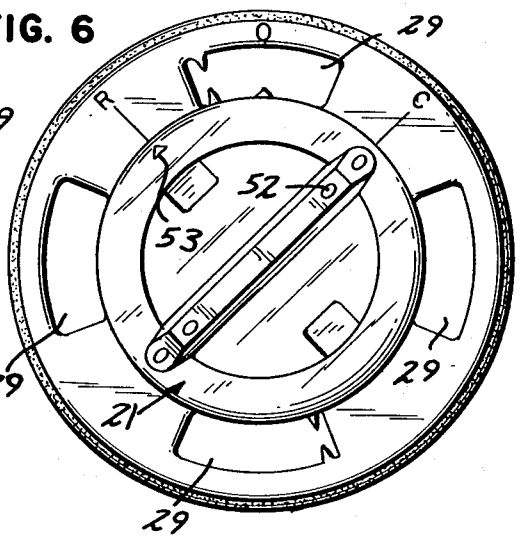
FIG. 6 is a top plan view of the embodiment in FIG. 1, with the lid in the remove position and the lid removal indicator, e.g. a loop of wire, not intact.
Figure 5:
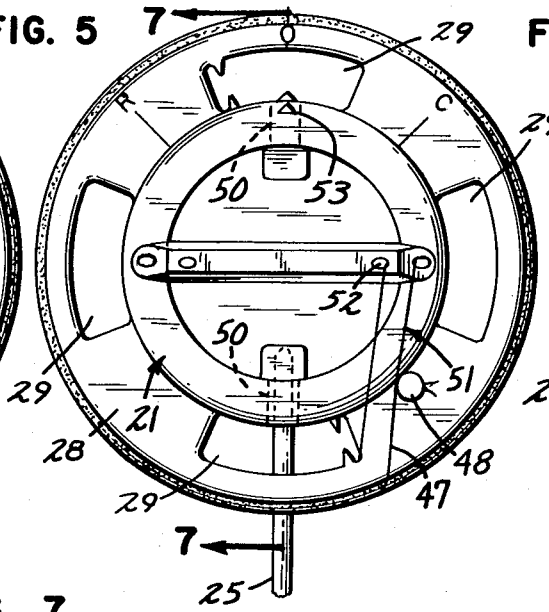
FIG. 5 is a top plan view of the embodiment in FIG. 1, with the lid in the access or open position, the dispensing hose inserted and a lid removal indicator, a loop of wire, is intact.

The bayonet groove 41 and lug 44 cooperate to permit the lid 21 to have three positions: a closed position, illustrated in FIG. 4; an access position, illustrated in FIG. 5; and a remove position, illustrated in FIG. 6. There are preferably two lugs 44, 180° apart, on the lid 21, and two grooves 41, also 180° apart, in the container 20.

When the lid 21 is in the closed position, illustrated in FIG. 4, the lug 44 is in the groove 41 and the lid apertures 49 are not aligned with the container apertures 50. Thus, there is no access, either for the dispensing tube 25 or for venting purposes, to the liquid food product within the container 20. A lid removal indicator 51 is comprised of a wire 47 and a breakable sealing member 48. The wire 47 extends through a handle hole 29 and a lid hole 52. The lid hole 52 extends through an upper portion of the lid 21 and does not penetrate the lower surface of the lid 21 that actually seals the container 20. When the lid 21 is in the closed position, the lid removal indicator 51 is in a first state with the sealing member 48 unbroken.

When the lid 21 is in the access position, as illustrated in FIG. 5, the lid apertures 49 are aligned with the container apertures 50. The lugs 44 are still engaged in the bayonet groove 41, however, and the lid 21 cannot be lifted from the container 20. This can more easily be seen in FIG. 4; the access position of the lid 21 could be accomplished by rotating the lid 21 as shown in FIG. 4 approximately 45° counterclockwise. Referring back to FIG. 5, the fact that the access position has been reached is indicated by a lid pointer 53 being adjacent to the mark "O" on the handle ring. Note also that the mark "C" corresponds to the closed position of lid 21.

Figure 7:
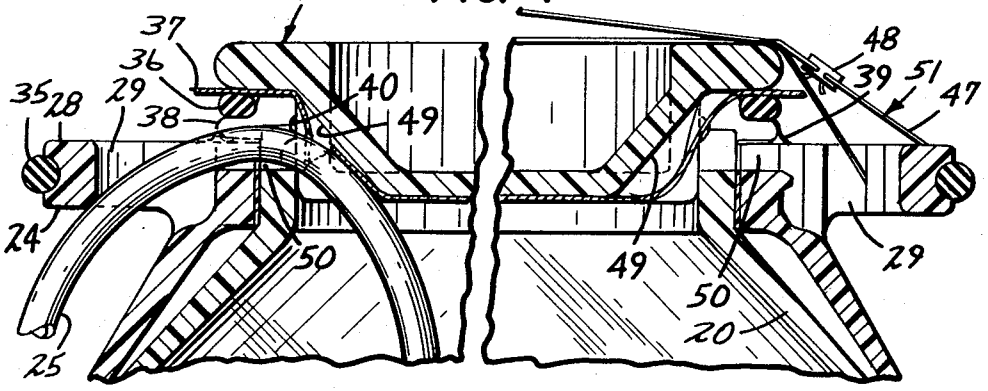
FIG. 7 is an enlarged and cross-sectional view of the top portion of the embodiment in FIG. 1 as shown in plan in FIG. 5, taken generally along line 7—7.

FIG. 7, a view along line 7—7 of FIG. 5, more clearly shows how access tube 25 is inserted through aligned apertures 49 and 50. The dispensing tube 25 is inserted through the container aperture 50 and the lid aperture 49 but, in order to be further inserted into the container 20, the access seal 37 is deformed or broken. It should be noted that a vent is provided by the other pair of aligned apertures on the opposite side of the lid 21 and container 20, and that the access seal 37 need not necessarily be pierced in order to effect a vent.

FIG. 6 shows the lid 21 in the remove position as indicated by the lid pointer 53 being in alignment with the mark "R" on the handle ring 28. In the remove position, the lug 44 is no longer engaged with the bayonet groove 41 so that the lid 21 may be lifted from the container 20. The absence of the lid removal indicator 51 is indicative of the fact that the lid 21 has been placed in the remove position.

Figure 8:
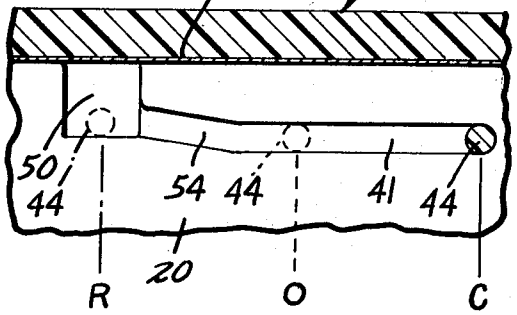
FIG. 8 is an elevation in cross section of the lid and container interface of the embodiment in FIG. 1 showing the bayonet groove in the container and the corrresponding lug that extends from the lid.

In order to more fully describe the bayonet assembly, FIG. 8 shows the bayonet groove 41 and lug 44 in the three positions corresponding to close, access and remove. When the lid 21 is in the close position, lug 44 is engaged in the groove 41 and is at its most clockwise position when the lid is viewed from the top. This is indicated by the lug 44 in its right-most position and corresponding to the mark, "C". When the lid 21 is in the access position, the lug 44 is in the intermediate position as indicated by the mark "O" in FIG. 8. Finally, when the lid 21 is in the remove position, the lug 44 is not engaged with the bayonet groove 41 and the lid can be lifted from the container 20. As shown in FIG. 8, the bayonet groove preferably has a downward sloping portion indicated generally at 54 that causes the lid 21 to be increasingly pressed against compressible seal 36 as the lid 21 is rotated clockwise.

Figure 10:
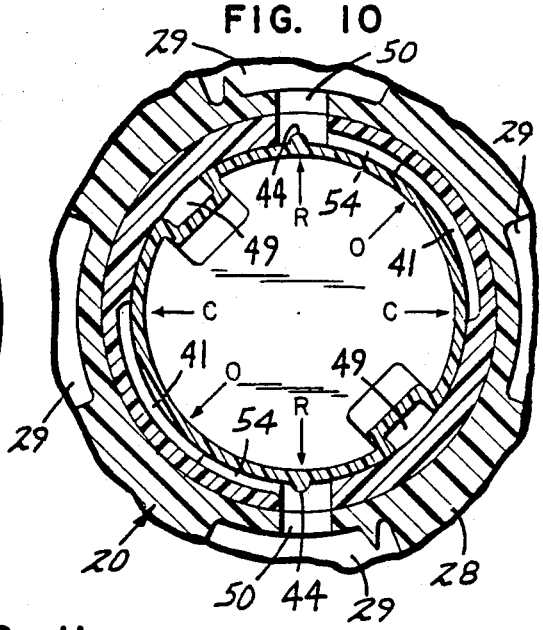
FIG. 10 is a cross-sectional plan view of the top section of the embodiment of FIG. 1, and more particularly a cross-sectional view of the lid taken generally along line 10—10 of FIG. 2, with the lid rotated to the remove position.

FIG. 10, a cross-sectional view of the lid in the remove position taken along line 10—10 of FIG. 2, shows the symmetry of the lid and container. The container apertures 50 receive lugs 44 when the lid 21 is placed onto the container 21. The lid 21 may then be rotated clockwise so that the lugs 44 engage the bayonet grooves 41 in the container 20. When the lugs 44 reach the position indicated by the mark "C", the lid is closed and there is no access to the liquid food products through the lid apertures 49 or the container apertures 50. It should be emphasized that the invention is not limited to a bayonet engagement scheme between the lid 21 and the container 20. The lid 21 and container could be threaded using, for example, an Acme style thread. Also, the lid 21 may simply be pressed into place with a friction fit between the container 20 and lid 21, or a lug-type lid closure using interrupted threads.

The operation of the invention can now be summarized with reference to the aforementioned figures. The container 20 is typically charged with a flowable product such as a liquid food product by a supplier; the access seal 37, e.g., waxed paper or other flexible film-like substance, is placed over the mouth of the container 20; and the lid 21 is placed in the closed position. The supplier then loops the wire 47 through the handle hole 29 and lid hole 52 and connect the ends of the wire with the sealing member 48. The charged and sealed container is then shipped to a food retailer.

The food retailer stores the charged container in a refrigerated area. The devices according to the invention can of course be stacked or nested in storage.

When it is time to dispense the flowable product such as a liquid food product, the charged container is placed near a dispensing machine and the lid 21 is put in the access position as indicated by the lid pointer being in line with the mark "O" on the handle 28. The dispensing tube 25 is then inserted through the container aperture 50 and the lid aperture 49, thus breaking or moving the frangible access seal 37. The dispensing tube 25 is inserted to the extent that the end 27 of the tube 25, as shown in FIG. 2, extends to the apex of the sump 26.

Upon completely dispensing the product in the device, the device is shipped back to the supplier for cleaning and refilling. The supplier rotates the lid 21 counterclockwise to the remove position, as shown in FIG. 6, and the lid 21 is lifted from the container 20 so that the container 20 may be cleaned, typically with a liquid cleaning solution. The supplier is ensured that the container has not been reused or refilled by the retailer or another supplier if the lid removal indicator 51 is intact prior to moving the lid 21 to the remove position.

After cleaning the container 20, the device is hung in an inverted orientation through the use of the hanging holes 31 in the rolling ring 30. The shape of the hanging hole 31 prevents the inverted device from assuming a vertical orientation and improves the draining and drying process.

Figure 9:
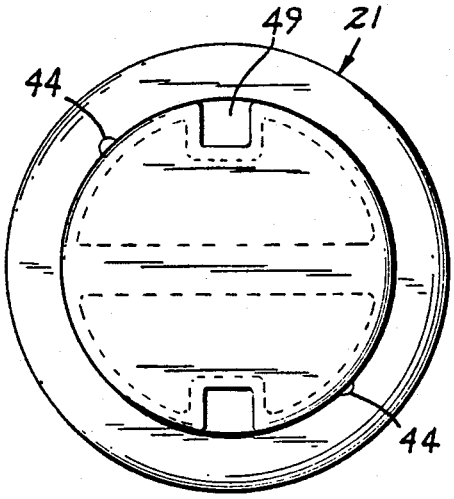
FIG. 9 is a view of the embodiment of FIG. 1 from inside the container looking upwards at the engaged lid.

FIG. 9 shows the lid 21 engaged to the container 20 from inside the container 20 looking upwards at the engaged lid. The lid apertures 49 in this view slope down and away from the viewer.

Figure 11:
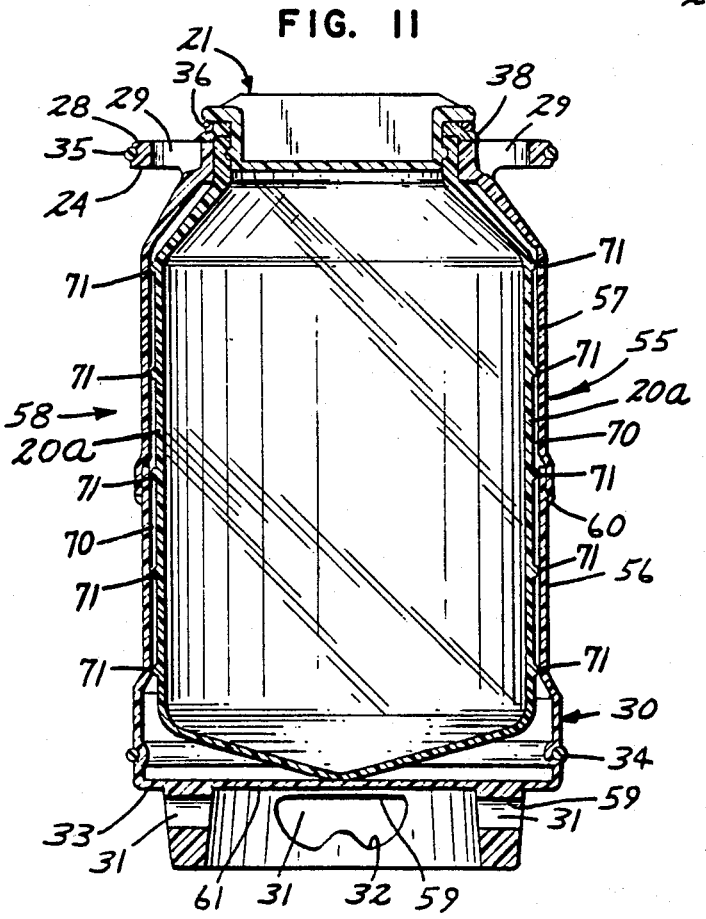
FIG. 11 is a cross-sectional elevation of a double-walled embodiment of the invention taken generally along a plane that contains the longitudinal axis of the container.

FIG. 11 shows a cross-sectional view of a double-walled embodiment of the invention, indicated generally as 58. The device 58 is similar to the device 23, a single-walled embodiment, illustrated in FIG. 2 except the container 55 of the device 58 has an additional rolling ring extension 56 and a handle ring extension 57 which form an outer wall 56, 57. An inner wall 20*a* is formed by what was the container 20 in the single-walled embodiment 22 and 23. The handle ring 28 and the rolling ring 30 are substantially similar for the double-walled embodiment 58 and the single-walled embodiment 23. The extensions, 56 and 57, are shown as integral extensions of the handle ring 28 and the rolling ring 30, respectively, but it is understood that the extensions could be separately fabricated components.

Construction of the double-walled embodiment 58 is similar to construction of the single-walled embodiment 23. A fifth spin weld 60 in the double-walled embodiment 58 is similar to the third spin weld 42 illustrated in FIG. 3 except that in the double-walled embodiment 58 the fifth spin weld 60 connects the handle ring extension 57 to the rolling ring extension 56. The handle ring extension 57 preferably overlaps the rolling ring extension 56 to provide a stronger container. With the exception of the extensions 56 and 57 which form an outer wall 56, 57 and fifth spin weld 60, the components of the double-walled embodiment 58 and single-walled embodiment 23 are substantially similar. This is illustrated by using some of the same reference numerals for both embodiments to show similar components, e.g. in FIG. 11, number 28 indicates a handle ring similar to handle ring 28 of the single-walled embodiment.

The double-walled embodiment is preferably made of plastic and is spin welded together as discussed above. A gap 70 is preferably formed between the inner wall 20*a* and the extensions 56 and 57 (outer wall 56, 57), with ribs 71, integral parts of inside wall 20*a*, holding the layers in spaced relationship. It is well understood by those skilled in the art of plastic fabrication techniques that the ribs 71 could alternatively be separately molded and subsequently bonded to either the inside wall 20*a* or the outside wall 56, 57.

The gap 70 can be filled with any of a variety of substances to improve the operating characteristics of the device 58. For instance, gap 70 can contain a "neutralizing" substance which will act to mitigate any deleterious effects caused by a leak in the device 58. If the liquid substance contained by the device 58 is highly acidic, gap 70 could contain a neutralizing base. In the event of a rupture of the inner wall 20 the base will mix with and neutralize the acid to limit the damage caused by the acid. Similarly, if the liquid substance within the container is highly flammable the gap 70 could contain a fire retardant, e.g., pressurized carbon dioxide. Rupturing of the container 20 (the inner wall 20*a* of the double-walled embodiment 58) will allow $CO_2$ to effectively "smother" any oxidation processes.

The double-walled embodiment 58 can also be supplied with means for encapsulating or capturing the liquid substance in the event of a rupture of the wall(s) of the container. For example, a sticky, viscous substance could be contained within the gap 70 to encapsulate a powdery "flowable" substance if the powdery substance should leak through the sidewall of the container 55 of double-walled device 58. Such a capturing gap filler can also be termed a "neutralizing" substance since by limiting the leakage of the powdery substance any potential negative effects are neutralized to some degree.

The material that is chosen to fill the gap 70 can also be a heat insulator which would act to decrease heat transfer through the inner and outer walls 20*a* and 56, 57. A synthetic heat-insulating foam could be injected following assembly of the device 58. Alternatively, the gap 70 could be partially evacuated to create a vacuum, a technique used in THERMOS bottles and the like. Those skilled in the art of plastic fabrication and heat transfer engineering recognize that any number of substances will decrease heat transfer to or from the inside of device 58.

In order to signal a breach of the sidewall of the device 58, an "indicator" substance could be used as a filler for the gap 70. Such an indicator substance would preferably be of gaseous phase and/or include a flowable submicron color particulate and have a noticeable odor and/or color which would "indicate" that a breach has occurred in the inner wall 20*a;* outer wall 56, 57; or both. A mercaptan, for example, having an extremely disagreeable garlic-like odor, can be added to a gaseous filler material for the gap 70. When a leak is present in the device 58, the disagreeable odor will, in effect, sound an "alarm." Other odorous or otherwise noticeable substances can be added to indicate a leak.

Finally, a structural foam or the like can be injected into the gap 70 to increase the strength of the device 58, making it more impregnable.

It should be noted that a single "gap filler" could possess more than one of the desirable characteristics discussed above. That is, a substance could thermally insulate and structurally improve the device 58; or, the gap filler could neutralize a leaking liquid as well as indicate the presence of a leak.

Those skilled in the art will recognize that a gap filler can have a large variety of properties, and the substances listed above are merely ilustrative.

Numerous characteristics and advantages among inventions have been set forth in the foregoing detailed description. It will be understood, of course that this disclosure is in many respects, only illustrative. Changes may be made in details, particularly in matters of shape, size, and arrangement of parts without exceeding the scope of the invention. The scope of the invention is defined in the language in which the appended claims are expressed.

I claim:

1. A device for storing and dispensing a flowable substance comprising:

(a) a container adapted to hold the flowable substance having a top end; a bottom end; a container sidewall having an inner surface and an outer surface; and said container forming a container aperture proximate to said top end;

(b) a multiply positionable lid, having, with respect to said container aperture, a closed position, an access position and a remove position, said lid adapted to sealably and removably engage said top end of said container and said lid having a lid aperture;

(c) a frangible access seal interposed between said container and said lid; and (d) a two-state lid removal indicator operably connected to said lid and said container, whereby, assuming that said lid removal indicator is initially in a first state, when said lid is in said closed position, the flowable substance is inaccessible and said indicator is in said first state; when said lid is in said access position, said container aperture is aligned with said lid aperture allowing access to the flowable substance upon altering said frangible access seal and said indicator is in said first state; and when said lid is in said remove position said lid removal indicator is irreversibly in a second state, and said lid can be removed to allow replacement of said frangible access seal.

2. The device as recited in claim 1, wherein said container sidewall is comprised of a plurality of layers.

3. The device as recited in claim 2, wherein said plurality of layers comprises an inner layer and an outer layer and said layers are in a spaced relationship to form a void therebetween.

4. The device as recited in claim 3, wherein said void contains a neutralizing substance, said neutralizing substance coming into operative contact with said flowable substance in the event of a breach of said inner layer and acting to mitigate deleterious effects otherwise caused by said flowable substance in the event of a breach of said outer layer of said container sidewall.

5. The device as recited in claim 4, wherein said flowable substance comprises an acid and said neutralizing substance comprises a base.

6. The device as recited in claim 4, wherein said flowable substance is flammable and said neutralizing substance comprises a fire retardant.

7. The device as recited in claim 4, wherein said neutralizing substance comprises a capturing substance which acts to decrease the leakage of said flowable substance through a breach of said container sidewall.

8. The device as recited in claim 3, wherein said void contains a heat insulating substance which acts to decrease heat transfer through said container sidewall.

9. The device as recited in claim 8, wherein said void contains a gaseous substance at a pressure less than an ambient pressure which surrounds said container proximate to said outer surface of said container sidewall.

10. The device as recited in claim 8, wherein said void contains a heat-insulating foam material.

11. The device as recited in claim 3, wherein said void contains an indicator substance which is detectable if said indicator substance is allowed to escape from said void.

12. The device as recited in claim 11, wherein said indicator substance comprises an odorant susceptible to detection by an average human olfactory system.

13. The device as recited in claim 11, wherein said indicator substance comprises a colorant susceptible to being seen by a human having average eyesight.

14. The device as recited in claim 3, wherein said void contains a strengthening substance which increases the strength of said container sidewall, whereby said container sidewall better resists deformation and rupture.

15. The device as recited in claim 1, wherein said container and said lid are made of plastic.

16. The device as recited in claim 15, wherein said container is made of a plastic through which visible light can pass, thereby permitting direct observation of the amount of the flowable substance remaining in said container without removing said lid.

17. The device as recited in claim 1, further comprising a rolling ring having a top edge, a bottom edge and a rolling ring sidewall and having a hanging hole in said rolling ring sidewall, whereby said top edge of said rolling ring is fixed to said bottom end of said container and said bottom edge is substantially circular.

18. The device as recited in claim 17, wherein said container, said lid and said rolling ring are made of plastic.

19. The device as recited in claim 18, wherein said container is made of a plastic through which visible light can pass, thereby permitting direct observation of the amount of the flowable substance remaining in said container without removing said lid.

20. The device as recited in claim 1, wherein said container in combination with said lid are adapted to cooperatively engage a bottom end of another container so that multiple containers may be nested together.

21. The device as recited in claim 1, wherein said container has a circular cross-section.

22. The device as recited in claim 1, further comprising a handle ring having an inner surface, an outer surface, an upper surface and a lower surface and having a handle hole, said inner surface of said handle ring fixedly connected to said outer surface of said container proximate to said top end of said container, whereby said handle hole is sufficiently large to accommodate an average adult human hand.

23. The device as recited in claim 22, wherein said lower surface of said handle ring is substantially planar and substantially parallel to said bottom end of said container, and is thereby adapted to engage the tynes of a forklift.

24. The device as recited in claim 1, further comprising a nipple secured to said container, said nipple adapted to cooperatively engage a hole in an identification card.

25. The device as recited in claim 1, wherein said container and said lid are adapted to engage on another in bayonet fashion.

26. The device as recited in claim 1, wherein said inner surface of said container is funnel shaped at said bottom end of said container, with an apex of said funnel proximate to said bottom end of said container.

27. The device as recited in claim 1, wherein said two-state removal indicator is a loop of metal wire having its ends joined by a frangible sealing member.

28. The device as recited in claim 1, wherein said access seal is waxed paper.

29. A device for storing and dispensing a flowable substance comprising:

(a) a container adapted to hold the flowable substance including a container sidewall having an inner surface and an outer surface; and said container further having a top end, a bottom end, and an aperture proximate to said top end through which the flowable substance may pass, and further adapted to sealably and removably engage a lid at said top end of said container, said lid, when properly positioned, sealing said aperture;

(b) a rolling ring having a top edge, a bottom edge, and a rolling ring sidewall having an inner surface and an outer surface, said bottom end of said container being fixedly connected to said top edge of said rolling ring and said bottom edge of said rolling ring having a substantially circular shape and adapted to rest on a substantially planar horizontal surface, said rolling ring having a hanging hole through said rolling ring sidewall, said hanging hole having an upper edge and a lower edge with said lower edge of said hanging hole being proximate to said bottom edge of said rolling ring, whereby said lower edge of said hanging hole is not substantially parallel to said bottom edge of said rolling ring in a radial direction or in a tangential direction.

30. The device as recited in claim 29, wherein said container sidewall is comprised of a plurality of layers.

31. The device as recited in claim 30, wherein said plurality of layers comprises an inner layer and an outer layer and said layers are in a spaced relationship to form a void therebetween.

32. The device as recited in claim 31, wherein said void contains a neutralizing substance, said neutralizing substance coming into operative contact with said flowable substance in the event of a breach of said inner layer and acting to mitigate deleterious effects otherwise caused by said flowable substance in the event of a breach of said outer layer of said container sidewall.

33. The device as recited in claim 32, wherein said flowable substance comprises an acid and said neutralizing substance comprises a base.

34. The device as recited in claim 32, wherein said flowable substance is flammable and said neutralizing substance comprises a fire retardant.

35. The device as recited in claim 32, wherein said neutralizing substance comprises a capturing substance which acts to decrease the leakage of said flowable substance through a breach of said container sidewall.

36. The device as recited in claim 31, wherein said void contains a heat insulating substance which acts to decrease heat transfer through said container sidewall.

37. The device as recited in claim 36, wherein said void contains a gaseous substance at a pressure less than an ambient pressure which surrounds said container proximate to said outer surface of said container sidewall.

38. The device as recited in claim 36, wherein said void contains a heat-insulating foam material.

39. The device as recited in claim 31, wherein said void contains an indicator substance which is detectable if said indicator substance is allowed to escape from said void.

40. The device as recited in claim 39, wherein said indicator substance comprises an odorant susceptible to detection by an average human olfactory system.

41. The device as recited in claim 39, wherein said indicator substance comprises a colorant susceptible to being seen by a human having average eyesight.

42. The device as recited in claim 31, wherein said void contains a strengthening substance which increases the strength of said container sidewall, whereby said container sidewall better resists deformation and rupture.

43. The device as recited in claim 29, wherein said container, said lid and said rolling ring are made of plastic.

44. The device as recited in claim 43, wherein said container is made of a plastic through which visible light can pass, thereby permitting direct observation of the amount of the flowable substance remaining in said container without removing said lid.

45. The device as recited in claim 29, wherein said container in combination with said lid are adapted to cooperatively engage a bottom edge of a rolling ring of another substantially similar container so that multiple devices may be nested together.

46. The device as recited in claim 29, wherein said container has a circular cross-section.

47. The device as recited in claim 29, further comprising a handle ring having an inner surface, an outer surface, an upper surface and a lower surface and having a handle hole, said inner surface of said handle ring fixedly connected to said outer surface of said container proximate to said top end of said container, whereby said handle hole is sufficiently large to accommodate an average adult human hand.

48. The device as recited in claim 47, wherein said lower surface of said handle ring is substantially planar and substantially parallel to said bottom end of said container, and is thereby adapted to engage the tynes of a forklift.

49. The device as recited in claim 47, wherein said hanging hole and said handle hole are offset approximately 45° from one another with reference to an axis of said container extending from said top end to said bottom end of said container.

50. The device as recited in claim 29, wherein an outside diameter of said bottom edge of said rolling ring is less than an outer dimension of said rolling ring at a point distant from said bottom edge of said rolling ring, whereby a ledge is formed in said rolling ring having a surface substantially parallel to said bottom edge of said rolling ring, said ledge being adapted to engage the tynes of a forklift proximate to said outer surface of said rolling ring.

51. The device as recited in claim 29, wherein said container and said lid are adapted to engage one another in bayonet fashion.

52. The device as recited in claim 29, wherein said lower edge of said hanging hole is arcuate in said tangential direction.

53. The device as recited in claim 52, wherein said lower edge of said hanging hole is substantially sinusoidal in said tangential direction.

54. A device for storing and dispensing a flowable substance comprising:

(a) a plastic container adapted to hold the flowable substance having a top end; a bottom end; and a container sidewall having an inner surface and an outer surface and said container having a container aperture proximate to said top end through which the flowable substance may pass, and further adapted to sealably and removably engage a multiply positionable plastic lid in bayonet fashion, said lid having a lid aperture;

(b) a frangible access seal interposed between said container and said lid;

(c) a two-state lid removal indicator operably connected to said lid and said container;

(d) a rolling ring having a hanging hole, a bottom edge and a top edge, said top edge of said rolling ring fixed to said bottom end of said container; and (e) a handle ring having an inner surface and an outer surface, said inner surface of said handle ring being fixed to said outer surface of said container proximate to said top end of said container and said handle ring having a handle hole; whereby said bottom end of said container and said handle ring are adapted to engage forklift tynes and said lid has a closed position, an access position and a remove position, said access position aligning said container aperture and said lid aperture enabling access to the flowable substance upon the altering of said access seal, and whereby placing said lid in said remove position allows the removal of said lid allowing the replacement of said access seal and causes said removal indicator to assume a second state irreversibly indicating that said lid has been placed in said remove position.

55. The device as recited in claim 54, wherein said two-state removal indicator is a loop of metal wire having its ends joined by a frangible sealing member.

56. The device as recited in claim 54, wherein said access seal is waxed paper.

57. A device as recited in claim 54, wherein said sidewall of said container is comprised of a plurality of layers.

58. The device as recited in claim 57, wherein said plurality of layers comprises an inner layer and an outer layer and said layers are in a spaced relationship to form a void therebetween.

59. The device as recited in claim 58, wherein said void contains a neutralizing substance, said neutralizing substance coming into operative contact with said flowable substance in the event of a breach of said inner layer and acting to mitigate deleterious effects otherwise caused by said flowable substance in the event of a breach of said outer layer of said container sidewall.

60. The device as recited in claim 59, wherein said flowable substance comprises an acid and said neutralizing substance comprises a base.

61. The device as recited in claim 59, wherein said flowable substance is flammable and said neutralizing substance comprises a fire retardant.

62. The device as recited in claim 59, wherein said neutralizing substance comprises a capturing substance which acts to decrease the leakage of said flowable substance through a breach of said container sidewall.

63. The device as recited in claim 58, wherein said void contains a heat insulating substance which acts to decrease heat transfer through said container sidewall.

64. The device as recited in claim 63, wherein said void contains a gaseous substance at a pressure less than an ambient pressure which surrounds said container proximate to said outer surface of said container.

65. The device as recited in claim 63, wherein said void contains a heat-insulating foam material.

66. The device as recited in claim 58, wherein said void contains an indicator substance which is detectable if said indicator substance is allowed to escape from said void.

67. The device as recited in claim 66, wherein said indicator substance comprises an odorant susceptible to detection by an average human olfactory system.

68. The device as recited in claim 66, wherein said indicator substance comprises a colorant susceptible to being seen by a human having average eyesight.

69. The device as recited in claim 58, wherein said void contains a strengthening substance which increases the strength of said container sidewall, whereby said container sidewall better resists deformation and rupture.

70. A device for storing and dispensing a flowable substance comprising:

(a) a container of circular cross section made of a plastic through which visible light can pass, said container adapted to hold the flowable substance and said container having a top end, a bottom end, and a container sidewall having an inner surface and an outer surface, said inner surface of said container sidewall being funnel shaped at said bottom end of said container, with an apex of said funnel proximate to said bottom end of said container, and said container having a container aperture proximate to said top end through which the flowable substance can pass, and further adapted to sealably and removably engage a multiply positionable plastic lid in bayonet fashion, said lid having a lid aperture;

(b) a two-state lid removal indicator operably connected to said lid and said container;

(c) a rolling ring having a hanging hole, a bottom edge and a top edge, said top edge of said rolling ring fixed to said bottom end of said container, said bottom edge of said rolling ring being substantially circular, and said hanging hole having a lower edge that is not substantially parallel to said bottom edge of said rolling ring and said rolling ring forming a ledge having a substantially horizontal surface adapted to engage the tynes of a forklift;

(d) a handle ring having a lower surface, said handle ring fixedly attached to said container near said top end of said container, said handle ring having a handle hole that is sufficiently large to accommodate an average adult human hand, and said handle hole being angularly offset from said hanging hole by approximately 45°, and said lower surface of said handle ring being adapted to engage the tynes of a forklift; and (e) a nipple secured to said container, said nipple adapted to cooperatively engage a hole in an identification card, whereby said container in combination with said lid are adapted to cooperatively engage a bottom edge of a rolling ring of another substantially similar container so that multiple devices may be nested together, and whereby when said lid is in a closed position, the flowable substance is inaccessible and said indicator is in a first state; when said lid is in an access position, said container aperture is aligned with said lid aperture allowing access to the flowable substance and said indicator is in said first state; and when said lid is in a remove position said lid removal indicator is irreversibly in a second state, and said lid can be removed from said container.

71. The device as recited in claim 70, wherein said container sidewall is comprised of a plurality of layers.

72. The device as recited in claim 71, wherein said plurality of layers comprises an inner layer and an outer layer and said layers are in a spaced relationship to form a void therebetween.

73. The device as recited in claim 72, wherein said void contains a neutralizing substance, said neutralizing substance coming into operative contact with said flowable substance in the event of a breach of said inner layer and acting to mitigate deleterious effects otherwise caused by said flowable substance in the event of a breach of said outer layer of said container sidewall.

74. The device as recited in claim 73, wherein said flowable substance comprises an acid and said neutralizing substance comprises a base.

75. The device as recited in claim 73, wherein said flowable substance is flammable and said neutralizing substance comprises a fire retardant.

76. The device as recited in claim 73, wherein said neutralizing substance comprises a capturing substance which acts to decrease the leakage of said flowable substance through a breach of said container sidewall.

77. The device as recited in claim 72, wherein said void contains a heat insulating substance which acts to decrease heat transfer through said container sidewall.

78. The device as recited in claim 77, wherein said void contains a gaseous substance at a pressure less than an ambient pressure which surrounds said container proximate to said outer surface of said container.

79. The device as recited in claim 77, wherein said void contains a heat-insulating foam material.

80. The device as recited in claim 72, wherein said void contains an indicator substance which is detectable if said indicator substance is allowed to escape from said void.

81. The device as recited in claim 80, wherein said indicator substance comprises an odorant susceptible to detection by an average human olfactory system.

82. The device as recited in claim 80, wherein said indicator substance comprises a colorant susceptible to being seen by a human having average eyesight.

83. The device as recited in claim 72, wherein said void contains a strengthening substance which increases the strength of said container sidewall, whereby said container sidewall better resists deformation and rupture.

* * * * *